US007059513B2

(12) United States Patent
Daugs et al.

(10) Patent No.: US 7,059,513 B2
(45) Date of Patent: Jun. 13, 2006

(54) POS PODIUM INCORPORATING A SHORT DEPTH CASH DRAWER

(75) Inventors: Robert Daugs, Shoreview, MN (US); Mark Stulz, Victoria, MN (US); Duane Putnam, Blaine, MN (US)

(73) Assignee: APG Cash Drawer, Minneapolis, MN (US)

( * ) Notice: Subject to any disclaimer, the term of this patent is extended or adjusted under 35 U.S.C. 154(b) by 313 days.

(21) Appl. No.: 10/342,106

(22) Filed: Jan. 14, 2003

(65) Prior Publication Data

US 2003/0155418 A1 Aug. 21, 2003

Related U.S. Application Data

(60) Provisional application No. 60/348,577, filed on Jan. 14, 2002.

(51) Int. Cl.
*G07G 1/00* (2006.01)

(52) U.S. Cl. ..... 235/10; 235/22

(58) Field of Classification Search ..... 235/10, 235/22, 379, 383, 7 R
See application file for complete search history.

(56) References Cited

U.S. PATENT DOCUMENTS

| | | | | |
|---|---|---|---|---|
| 4,436,989 A | | 3/1984 | Schuldt | 235/22 |
| 5,371,344 A | | 12/1994 | Buie et al. | 235/1 R |
| 5,390,764 A | | 2/1995 | Kerber | 186/68 |
| D358,162 S | | 5/1995 | Buie et al. | D18/4 |
| 5,723,850 A | * | 3/1998 | Lambert | 235/22 |
| 6,390,363 B1 | | 5/2002 | Morrison et al. | 235/383 |

OTHER PUBLICATIONS

Cashier Console from P.O.S. Tech advertisement, Jun. 2002.

Cash Bases Inc. "The Advantage Range" advertisement, Sep. 1999.

Cash Bases Inc. "Technical Specifications", Sep. 1999.

Cash Bases, Inc. ""U" Shaped Drawer for Integration With a Flatbed Scanner", at least by Sep. 1999.

* cited by examiner

*Primary Examiner*—Karl D. Frech
(74) *Attorney, Agent, or Firm*—Westman, Champlin & Kelly, P.A.

(57) ABSTRACT

A short depth cash drawer including, a cash drawer and an opening device. The cash drawer includes an open top side, a till holding portion, a front portion, a rear portion, and an opening device interface region. The opening device opens the cash drawer when an input is received. The rear portion of the opening device does not extend beyond the rear portion of the cash drawer when the cash drawer is closed, and is located to one side of the cash drawer.

28 Claims, 7 Drawing Sheets

POS PODIUM INCORPORATING A SHORT DEPTH CASH DRAWER

The present application is based on and claims the benefit of U.S. provisional patent application Ser. No. 60/348,577, filed Jan. 14, 2002, the content of which is hereby incorporated by reference in its entirety.

BACKGROUND OF THE INVENTION

Cash drawers are commonly found in consumer retail outlets and are used to complete the consumer's purchase at a checkout point. Cash drawers typically hold a till or other feature that helps a cashier organize and sort currency used to pay for the consumer's purchase. Currency typically includes both paper currency (bills, checks, food stamps, etc.) and coin money. Depending on the country and culture where the cash drawer is used this paper currency is stored either on end or laying flat in the cash drawer.

Cash drawers are typically part of a larger cash register system. When the cash drawer is part of a cash register system, the drawer is typically kept below a register area. The register area generally includes a keypad having multiple keys which can indicate to a processor in the cash register the amount of an item a customer wishes to purchase, the specific item the customer wishes to purchase, or the price of the item. These keys can include a numeric keypad, an alpha numeric keypad, a listing of items typically purchased by customers at the establishment, a method of payment, or specialized keys for special or common transactions used by the establishment. In other arrangements the cash register system can be connected to a scanner, which can scan a universal product code (UPC) label or other product identifiers that are located on the product. This scanned UPC code is converted to a machine readable code that allows the processor to determine the price of the scanned item based upon a value stored for that product.

Cash drawers can also be used as part of a check stand or checkout lane. In the checkout lane configuration the cash drawer is typically part of the cash register system discussed above. In this arrangement the cashier often receives the products the customer wishes to purchase along a product path running from an unloading area, past the cashier, to a bagging area. Commonly, products are advanced along the product path from the unloading area to the cashier with a conveyer-type belt that moves the products from the unloading end of the check stand to the cashier. Once the products reach the cashier, the cashier scans the UPC codes for each product using a scanner that is installed on the check stand, or manually enters the price of the product on the keypad. The movement of the product across the scanner is also part of the product path. In some arrangements of the cash stand, the cashier may use a handheld scanner to scan items that are not on the belt, or are too bulky to pass by the scanning window of the installed scanner. The scanned UPC code is converted into a machine-readable code that allows the cash register to determine the price for the scanned item. After scanning, the cashier passes the product along the product path to a bagging station or loading area where the customer can pick up the purchased products.

Once the cashier has scanned all of the products which the customer purchased, the cash register calculates the price of all of the products the customer purchased, and presents the total to both the customer and the cashier. The cashier then requests payment from the customer. The customer either pays for the products with cash currency, with a check, or by electronic means, such as an ATM/debit card. If the consumer pays for the products with cash currency, the cashier must open the cash drawer to complete the sales transaction. In a typical arrangement of the cash stand the cash drawer is located in a position that requires the cashier to break eye contact with the customer in order to access and manipulate the contents of the cash drawer.

In one arrangement the cash drawer is located outside the product path, and requires the cashier to turn to the left or to the right of the customer to access the contents of the cash drawer. This arrangement prevents the cashier from keeping an eye on both the contents of the cash drawer and the customer. Often the cashier is in communication with the customer while the cash drawer is still open. In-store video surveillance has shown that when the cash drawer is open, and the cashier is looking at the customer, there is an increased likelihood that a person in another checkout lane, who may be working with the customer, can reach into the cash drawer and remove the contents without the cashier's knowledge. This is because the cashier is not looking at the contents of the drawer, and is distracted by the customer. To combat this problem several solutions have been proposed. However, none of these solutions provides an optimum position of the cash drawer in relationship to both the cashier and the customer.

One proposed solution is to place the cash drawer around the scanner. In this solution the cash drawer has a "U" shape with the base of the "U" facing the cashier. When the cash drawer is opened the top portion that covers the cash drawer pops up to allow access to the contents of the cash drawer. However, this drawer arrangement arranges the currency in locations that are uncommon to that normally encountered by the cashier. This arrangement results in cashier confusion, and increased checkout times, and as such is not often used.

Another proposed solution is to place the cash drawer below the scanner. When the cashier finishes a transaction, the cash drawer opens below the scanner, and moves towards the cashier. The cashier is required to move away from the scanner, and the customer in order to avoid being injured or hit by the cash drawer as it opens. The contact point in this arrangement commonly occurs between the knee and hip of the cashier. Further, this arrangement forces the cashier to bend down in order to access the contents of the cash drawer resulting in poor ergonomics, and increased risk of injury.

Another variation of placing the cash drawer below the scanner is to place the cash drawer either to the left or to the right of the cashier such that when the drawer opens, the drawer opens below the top surface of the scanner. However, this arrangement also has drawbacks. For example, when the cash drawer is placed to the right of the cashier, the drawer opens towards the cashier, and enters into the space of the cashier station. The cashier, again, must step back away from the path of the cash drawer, or move to the left, in order to avoid being hit by the cash drawer. The cashier also must bend down to access the contents of the cash drawer, once again resulting in poor ergonomics, and increased risk of injury.

Yet, another proposed solution places the cash drawer above the product path that the goods take as they are passed over the scanner during the scanning process. The cash drawer is raised significantly above the top surface of the scanner. In systems that feature this design, the check stand is wider than the scanning portion in the area where the cash drawer opens. This extra width is required to accommodate components of the cash drawer necessary to open the cash drawer. Further, these designs typically require the cashier to move from a scanning position to a second position away from the scanner, as the cash drawer is not located in line with the scanner. This arrangement of the cash drawer and scanner is required because the dimensions of the cash drawer components are not functionally compatible with the dimensions of the scanner. Since the cashier must move to access the contents of the cash drawer additional time is added to complete the transaction.

It is estimated that the time required for the cashier to move to access the contents of the cash drawer and complete the transaction ranges between three and ten seconds per transaction in these prior art cash drawer arrangements. This additional time can add up to minutes a day, reducing the overall efficiency of the retail establishment, as more time is required to check out each customer. Further, as the width of the check stand is greater than the scanner, additional valuable floor space is required for the check stand, which could be used for selling high profit items. Therefore, it is desirable for a cash drawer and check stand arrangement that minimizes both size and cashier movement.

SUMMARY OF THE INVENTION

The present invention is directed to a short depth cash drawer including a cash drawer and an opening device. The cash drawer includes an open top side, a till holding portion, a front portion, a rear portion, and an opening device interface region. The opening device interface region is located to one side of the cash drawer. The opening device opens the cash drawer when an input is received. Further, the rear portion of the opening device does not extend beyond the rear portion of the cash drawer when the cash drawer is closed.

In one embodiment the cash drawer includes a till that is configured to store paper currency in a flat configuration. In an alternative embodiment the till is configured to store paper currency in an end on configuration. In some embodiments the cash drawer includes a housing which holds the cash drawer in place in a cash register and includes a top surface, a bottom surface, a back section, and two side sections. The back and two side sections are each connected to an edge of the top surface and connected to an edge of the bottom surface.

Another embodiment of the present invention is directed to a method of checking out a customer. The method includes providing a cash drawer generally above the work surface of the cash stand and generally inline with, but not over, the scanner and occupying a scanning position that is inline with the scanner and the cash drawer. The method further includes scanning a product with the scanner while remaining in the scanning position. Further the method includes opening the cash drawer over the scanner, and accessing the contents of the cash drawer while remaining generally in the scanning position.

DETAILED DESCRIPTION OF THE PREFERRED EMBODIMENTS

Figure 1A:
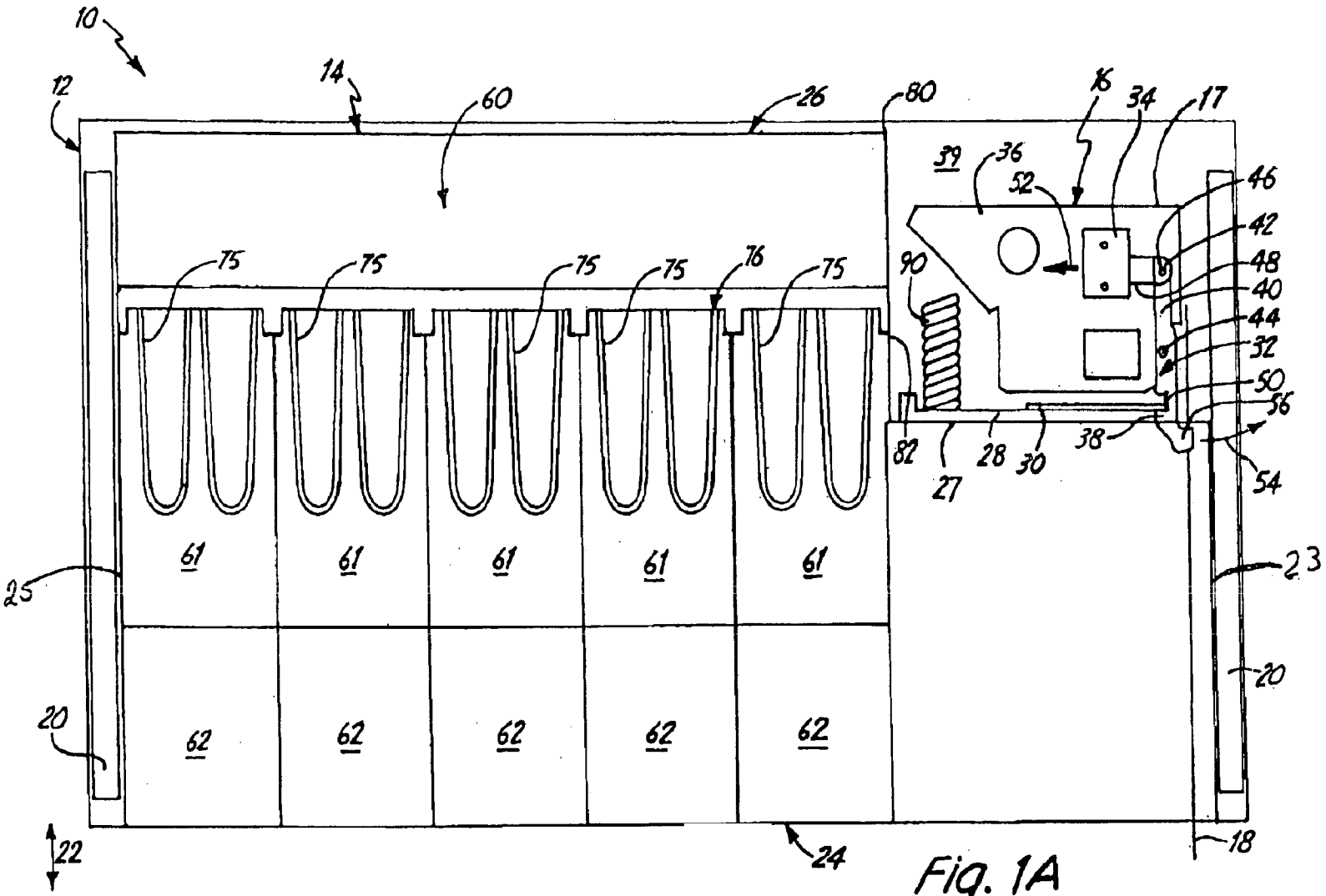
FIG. 1A is a top plan view of a cash drawer assembly.

FIG. 1A is a top plan view of a cash drawer assembly 10 according to one embodiment of the present invention with a top portion 78 (shown in FIG. 1B) of housing 12 removed for clarity. Cash drawer assembly 10 includes a housing 12, a cash drawer 14, a latch mechanism 16 and a key locking mechanism 18. Drawer 14 is slidably mounted within housing 12 by a pair of slides 20 mounted on opposite sides of housing 12. Drawer 14 is slidable within housing 12 and slides on slides 20 in the direction indicated by arrow 22. While a pair of slides 20 are illustrated in FIG. 1A, those skilled in the art will realize that other support arrangements and/or number of slides 20 can also be used.

Commonly, a cash tray or till 60 is inserted into drawer 14. The cash tray 60 typically has a number of dividers 61 and 62 for storing currency, coupons and other items required in a cash register system. Depending on the country or the specific culture where the cash tray 60 is used, paper currency is stored in different positions or arrangmenets. Commonly, in the United States, paper currency is stored in dividers 61 in a flat position as illustrated in FIG. 1A, and is sorted by value. Metal or coin currency is commonly stored in dividers 62 and is also sorted by value. However, in Europe it is common to store paper currency in dividers 61 in an end on configuration (not illustrated).

Figure 1B:
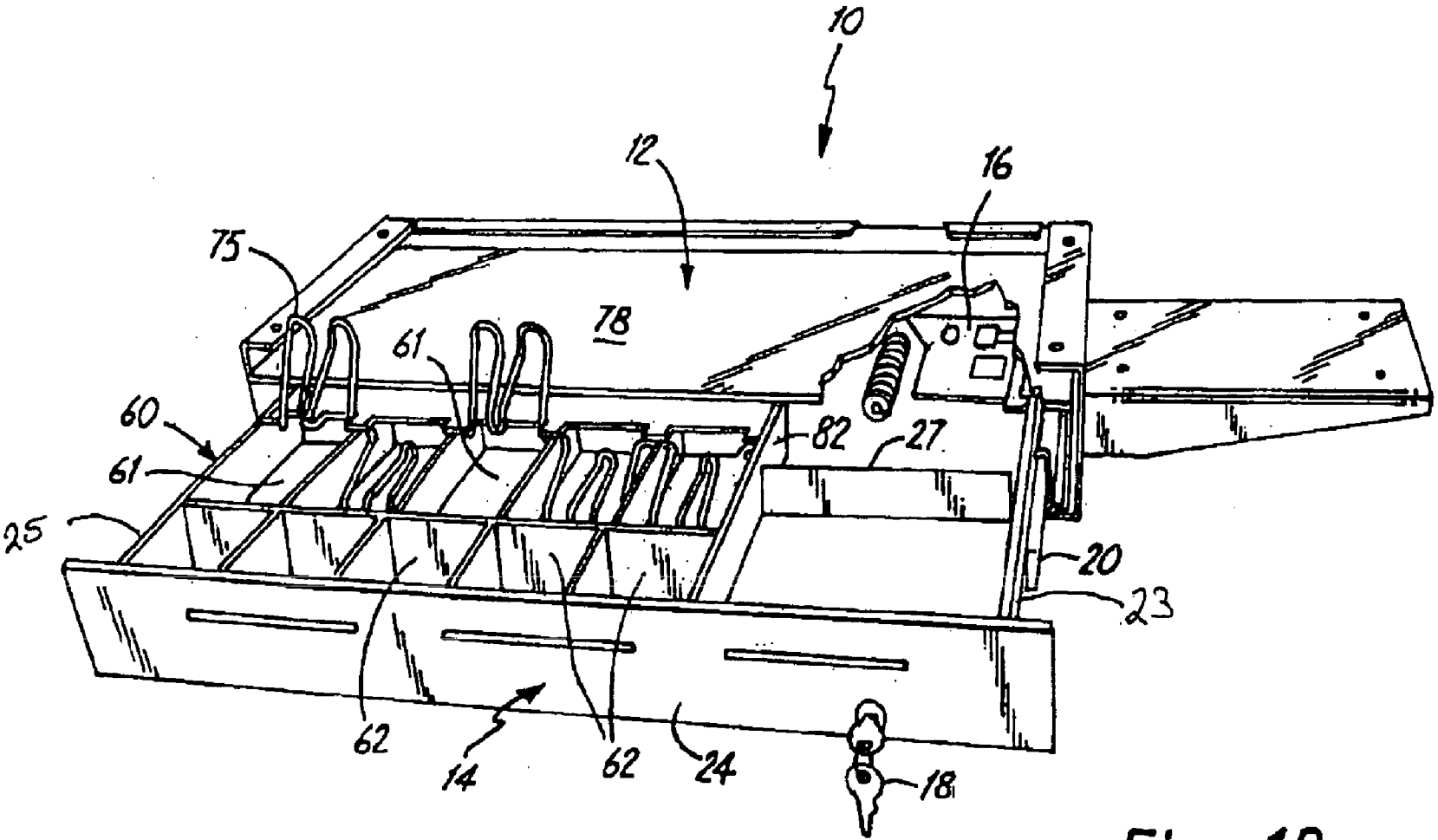
FIG. 1B is a perspective view of an open cash drawer in cash drawer assembly.

When cash tray 60 is configured to store paper currency in a flat position, the cash tray is commonly equipped with currency holder arms 75. Currency holder arms 75 are in one embodiment a flip-up arm that rotates about a pivot 76. When cash drawer 14 is opened, a cashier can access the currency in the cash tray 60 by lifting up currency holder arms 75, as illustrated in FIG. 1B. When the cash drawer 14 is closed, currency holder arms 75 are pushed down as they come into contact with a top portion 78 of housing 12. This causes the currency holder arm 75 to pivot about pivot 76 and press down on the currency contained in the respective currency divider 61, thus holding the paper currency in place.

Cash drawer 14 has a front face or panel 24, a rear panel 26, and an intermediate panel 27 recessed from rear panel 26. A locking plate 28 is attached to panel 27. Locking plate 28 extends downwardly towards the bottom of panel 27, and has a locking tab portion 30 which is substantially collinear with, and coplanar with, the remainder of plate 28.

Latch mechanism 16 includes a pivotable rotary latch member 32 (rotary latch 32), and an electrically operated solenoid 34. Rotary latch 32 and solenoid 34 are mounted on a mounting plate 36 which is in turn mounted on a base plate 39 of housing 12. Rotary latch 32 has a forward portion 38, an intermediate portion 40 and a rearward portion 42. Rotary latch 32 pivots about pivot point 44 which is disposed generally at the intermediate portion of rotary latch 32.

Solenoid 34 is pivotably coupled to the rear portion 42 at pivot point 46. Solenoid 34 has a compression spring 48 disposed thereon which biases rotary latch 32 into the locking or latching position shown in FIG. 1. When in the locking position, a tab engaging surface 50 on the forward portion 38 of rotary latch 32 engages tab 30 of locking plate 28 thereby holding drawer 14 in the closed position shown in FIG. 1. Rotary latch 32 thus inhibits the movement of drawer 14 forwardly out of housing 12 into an open position illustrated in FIG. 1B. To open drawer 14, solenoid 34 is energized by receiving an input signal from an external control component (not illustrated). This input signal causes actuation of the solenoid 34.

Upon actuation of the solenoid, compression spring 48 is compressed by the solenoid and the rear portion 42 of rotary latch 32 is moved in a direction indicated by arrow 52. This causes the forward portion 38 of rotary latch 32 to pivot about an arc, as generally indicated by arrow 54. As forward portion 38 of rotary latch 32 pivots about arc 54, tab-engaging surface 50 disengages from tab portion 30 of plate 28, thus allowing drawer 14 to slide within housing 12.

Cash drawer assembly 10 is conventionally provided with a spring 90, which is coupled to base plate 39 of housing 12 and which biases drawer 14 to an open position. In the past such springs have taken the form of steel, resilient wire loops (e.g. made of piano wires) coupled to an upstanding post fastened to base plate 39. The wire loops are positioned to engage the second rear panel 27 of drawer 14 thus biasing drawer 14 to an open position. However, any other spring configuration can be used as well.

Forward portion 38 of rotary latch 32 is provided with a surface 56, which is disposed at an angle relative to arrow 22. Thus, when drawer 14 is moved from the open position to the closed position tab portion 30 engages surface 56 causing latch member 32 to rotate along arch 54 until tab portion 30 reaches tab engaging surface 50, at which time rotary latch 32 pivots back to the locking position shown in FIG. 1.

In contrast to the configuration of other cash drawers, latch mechanism 16 and spring 90 are located to a side of the cash drawer assembly 10. In the embodiment illustrated in FIGS. 1A and 1B, latch mechanism 16 is placed to the left-hand side of the rear portion of cash drawer 14. However, other locations of mechanism 16 can be used, such as to the right-hand side of cash drawer 14. Furthermore, in other embodiments the latch mechanism 16 and spring 90 can be placed either above cash drawer 14 or below cash drawer 14.

Rear portion 26 of cash drawer 14 is notched or recessed at point 80 creating a recessed area in cash drawer 14 where latch mechanism 16 and spring 90 can be inserted. Extending from point 80 towards the front 24 of cash drawer 14 is a side plate 82. Side plate 82 defines an inner edge surface of the recessed area between point 80 and second rear panel 27. The depth of the recess is determined by the depth of latch mechanism 16 and spring 90. The larger, hence deeper, the spring 90 and latch mechanism 16 are, the greater the depth of the recessed area. Of particular note, in the embodiment illustrated in FIG. 1A, the rear portion 17 of latch mechanism 16 does not extend beyond the rear portion 26 of cash drawer 14 when cash drawer 14 is in the closed position. This arrangement of latch mechanism 16 relative to the housing 12 allows the housing 12 to exhibit a significantly shorter depth than is present in traditional prior art cash drawers.

In one embodiment, cash drawer 14 has a depth of approximately 11 inches in contrast to the prior art's depth of 14½ inches. This decreased depth of the cash drawer 14 and the associated housing 12 allows an operator of multiple cash drawers 14 to increase the available salable floor space in the store when cash drawer 14 is used in a checkout lane without reducing the number of checkout lanes available. As the cash drawer 14 in the present embodiment has a depth that is approximately 3 inches shorter than the prior art cash drawer, an operator using four of these cash drawers would experience an increase in salable floor space equivalent to one, foot, without having to reduce the number of checkout lanes or change other configurations of the retail establishment. The integration of cash drawer 14 into a podium and a checkout lane will be discussed in further detail below.

Figure 2:
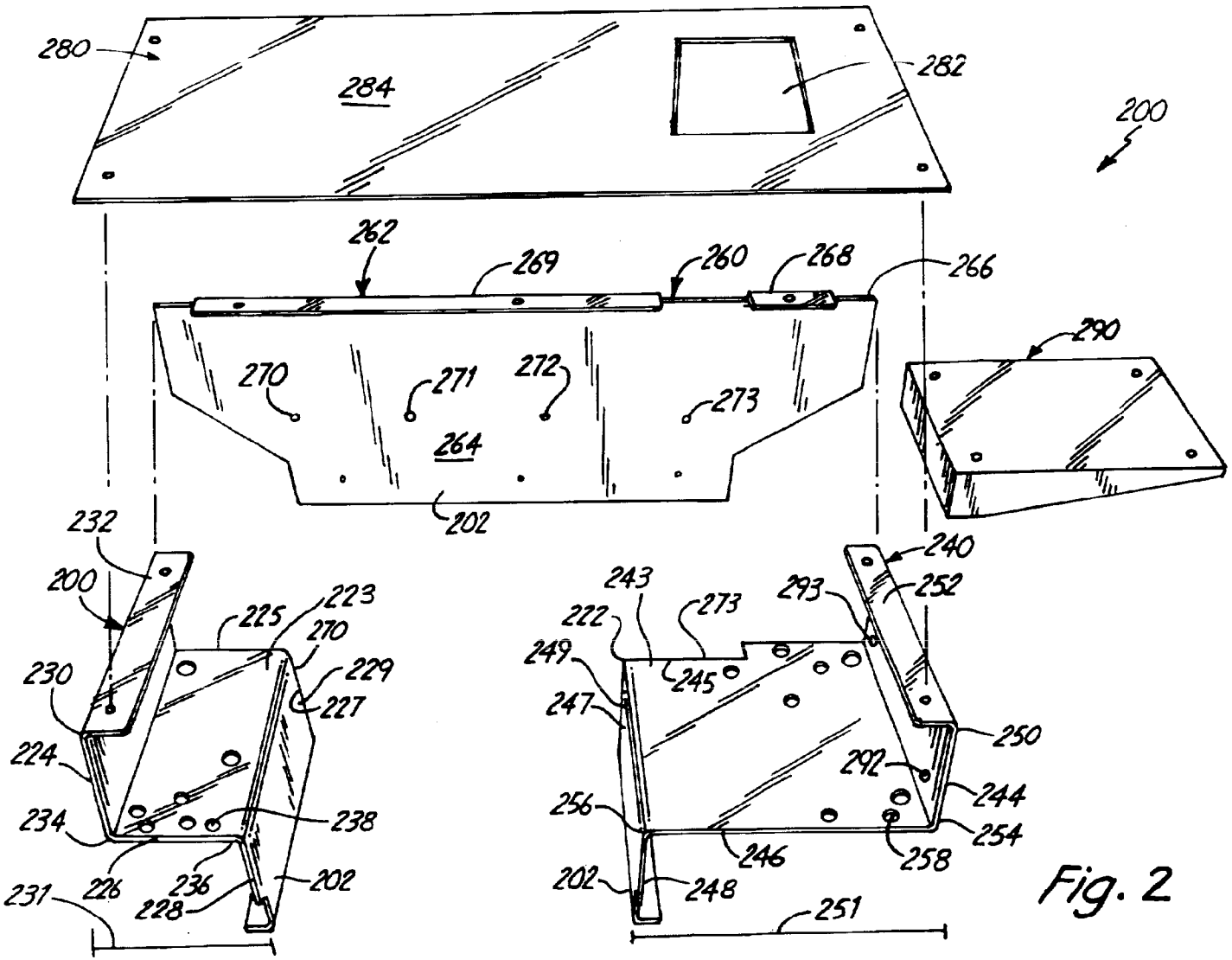
FIG. 2 is an exploded view of a podium configured to hold the cash drawer assembly.

FIG. 2 is an exploded view of a podium 200 according to one embodiment of the present invention. Podium 200 is configured to accept the cash drawer 14 and housing 12 described in FIGS. 1A and 1B. Podium 200 includes a first side plate 220, a second side plate 240, a back plate 260, and a top plate 280. Podium 200 has a base portion 202 where the podium 200 can be connected to or attached to a check stand surface. The depth of the first and second side plates 220 and 240 is marginally deeper then the depth of the cash drawer 14.

First side plate 220 is attached to one side of back plate 260, and has a generally "dog leg" type shape. However, other shapes can be used. First side plate 220 has a first side portion 224, a second side portion 228 and a garage bottom support 226. On a portion of a top portion 230 of the first side portion 220 is a flange 232. Flange 232 is provided to assist in the attachment of top plate 280.

The first side portion 224 extends from the top portion 230 to a first bend point 234. In one embodiment the first side portion has a height of approximately 3 inches, this height corresponding to the height of cash drawer assembly 10. However, depending on the height of the cash drawer assembly 10 other heights can be used. At first bend point 234 first side plate 220 bends at approximately 90° to form garage bottom support 226. Garage bottom support 226 extends from first bend point 234 to a second bend point 236.

Garage bottom support 226 has at least one hole 238 machined into the support 226. This hole 238 is sized such that a thumbscrew or other fastener can be fastened to the housing 12 of cash drawer assembly 10 in order to attach the cash drawer assembly 10 to the podium 200. At second bend point 236 the first side plate 220 bends again at approximately 90° and extends towards podium base 202, thus forming second side portion 228. On the back 225 of garage portion 226 and on the back 227 of side portion 228 are connection points 223 and 229 respectively. Connection points 223 and 229 allow for the attachment of first side plate 220 to the back plate 260. However, instead of connection points, other attachment methods can be used.

Second side plate 240 is attached to the side of base plate 260 that is opposite first side plate 220, and also has a generally "dog leg" type shape. Once again, other shapes can be used for side plate 240. Second side plate 240 has a first side portion 244, a second side portion 248 and a garage bottom support 246. On a portion of a top portion 250 of first side portion 244 is a flange 252. The flange 252 is provided to assist in the attachment of top plate 280.

First side portion 224 extends from top portion 250 to a first bend point 254. In one embodiment first side portion 244 has a height of 3 inches. This height corresponds to the height of cash drawer assembly 10. However, depending on the height of the cash drawer assembly 10 other heights can be used. At first bend point 254 second side plate 240 bends at approximately 90° to form a garage bottom support 246.

Garage bottom support 246 extends from first bend point 254 to a second bend point 256. Garage bottom support 246 has at least one hole 258 machined into the support 246. This hole 258 is sized such that a thumbscrew or other fastener can be fastened to housing 12 of cash drawer assembly 10 in order to attach the cash drawer assembly 10 to the podium 200. Garage bottom support 246 has a length 251 that is greater than the length 231 of garage support 226. At second bend point 256, the second side plate 240 bends again approximately 90°, and extends towards podium base 202 thus forming a second side portion 248. On the back 245 of garage bottom support 246, and on the back 242 of side portion 248 are connection points 243 and 249, respectively. Connection points 243 and 249 allows for the attachment of second slide plate 240 to back plate 260.

Back plate 260 is located on the side of the podium 200 that faces away from the cashier during normal operation of the cash drawer system. Back plate 260 has a customer facing side 262 and a cashier facing side 264. At a top portion 266 of back plate 260 flanges 268 and 269 are provided such that top plate 280 can be attached to podium 200. Holes 270, 271, 272, 273 are machined into back plate 260 such that first side plate 220 and second side plate 240 can be attached to the back plate 260. Generally, this attachment between the plates is accomplished through the use of screws, nuts and bolts, or other removable fasteners. However, other fasteners can be used. Holes 270, 271, 272 and 273 are machined into back plate 260 such that the holes 270, 271, 272, 273 line up with the connection point 223 on first side plate 220 and with connection point 243 on second side plate 240. The placement of holes 270, 271, 272, 273 is such that regardless of which side of back plate 260 the first and second side plates 220 and 240 are placed two of the holes 270, 271, 272, 273 will line up with the connection points 223, 243. For example, when the plates an assembled into podium 200 holes 270 and 272 are used for attaching first side plate 220 and second side plate 240 to back plate 260, if the product path is from left to right. The distance between holes 270 and 272 is approximately 10½ inches, which is the width of the current generation optical scanner. However, other widths can be used. However, if the product path is from right to left then holes 271 and 273 are used. This arrangement of holes 270, 271, 272, 273 reduces the cost of manufacturing the podium 200 as separate back plate 260, first side plate 220 and second side plate 240 are not required for cash stands where the product path moves from right to left or from left to right.

In a typical arrangement of podium 200 second side plate 240 is located on the side of the product path that is after or downstream of the scanner. Once the first side plate 220 and second side plate 240 are attached to back plate 260, top plate 280 can be attached to flanges 232, 252, 268 and 269. This attachment can be through the use of screws, nuts and bolts, or other removable fasteners. Once again other types of fasteners can be used. Top plate 280 can have a variety of surfaces depending on the end user's cash stand configuration. One example of top plate 280 is illustrated in FIG. 2. In the example shown in FIG. 2 a printer cutout 282 is shown in surface 284. However, depending on the needs of the end user surface 284 may be smooth, or it may have additional cutouts to accommodate other components. Top plate 280 provides a surface for the installation of common cash register equipment typically found on cash stands.

An optional check writing stand 290 can be attached to podium 200 to provide a stable writing environment for the customer to write a check, or sign a credit/debit card sales receipt. Check writing stand 290 is generally attached to the side of podium 200 that is downstream of the product path. In one embodiment, check writing stand 290 is attached to second side plate 240 through optional holes 292, 293, which are machined into the second side plate 240.

Figure 3:
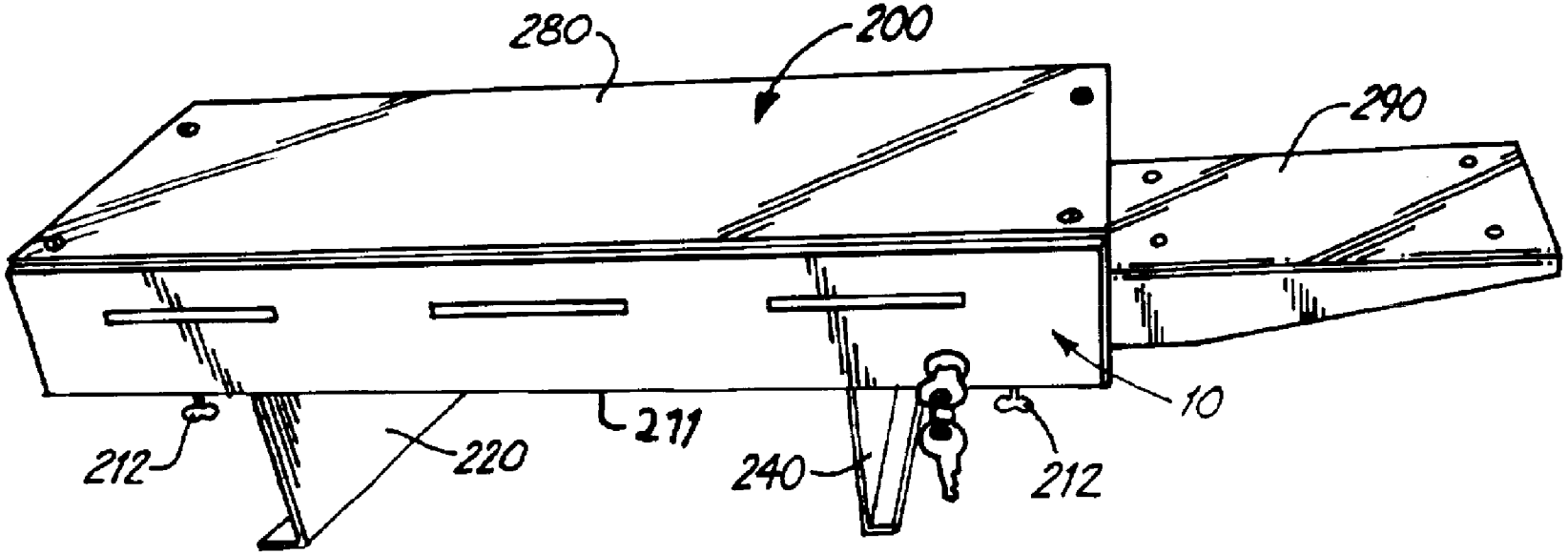
FIG. 3 is a perspective view of the podium of FIG. 2 with the cash drawer assembly of FIG. 1.

FIG. 3 illustrates an assembled podium 200 according to the embodiment described in FIG. 2. FIG. 3 also shows cash drawer assembly 10, such as the cash drawer assembly described in FIG. 1, installed into podium 200. Cash drawer assembly 10 is placed into the garage portion (FIG. 2) of podium 200. The base 211 of cash drawer assembly 10 rests on garage supports 228 and 248. Thumbscrews 212 or other removable fasteners are inserted through holes 238 and 258 and are tightened by hand. The benefit of using thumbscrews over other removable fasteners is that the user can remove the cash drawer assembly 10 from the garage without having to use tools. However, other fasteners can be used to secure cash drawer assembly 10 into the garage.

Figure 4A:
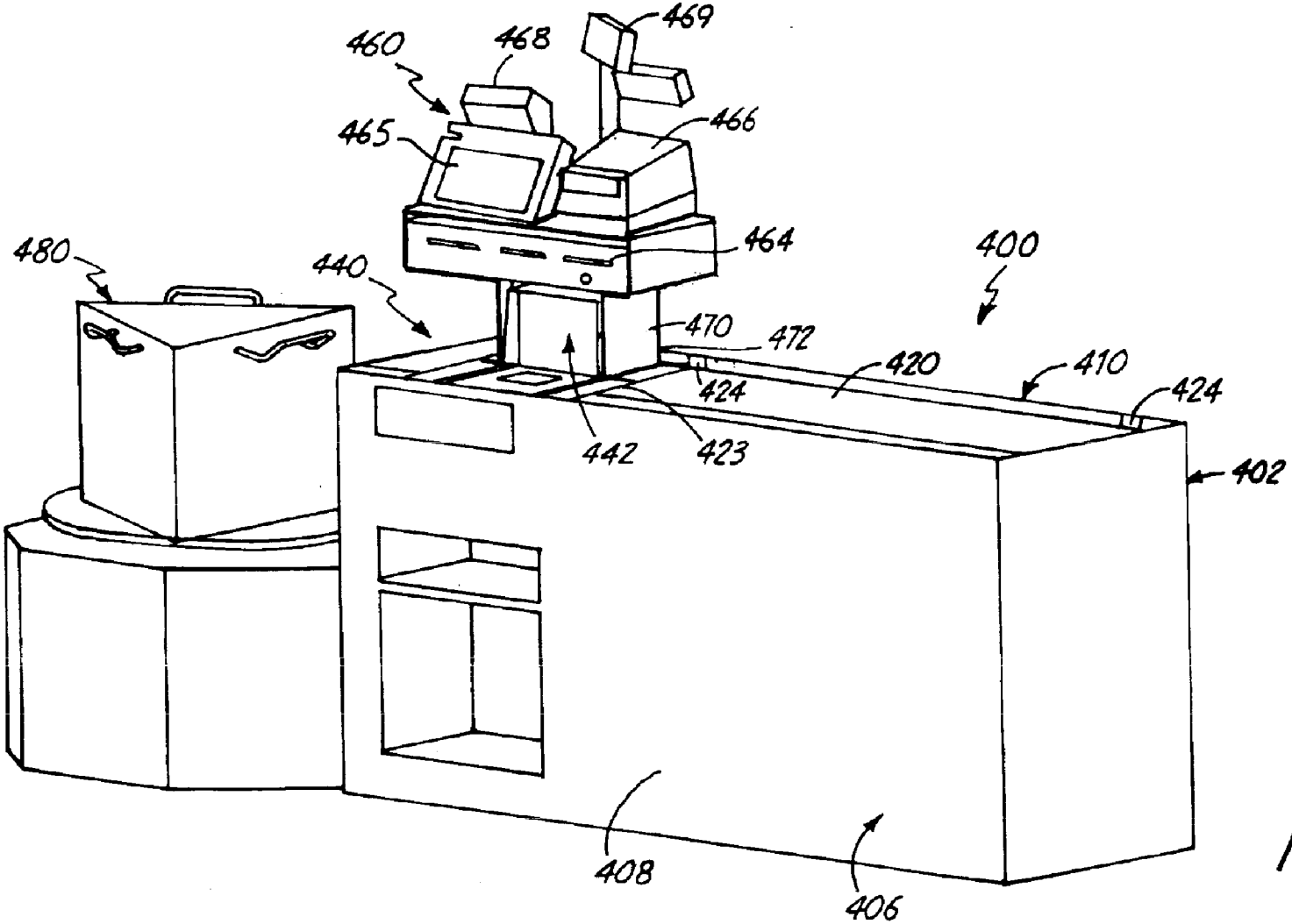
FIG. 4A is a perspective view of a cash stand incorporating the podium and cash drawer assembly of FIG. 3.
Figure 4B:
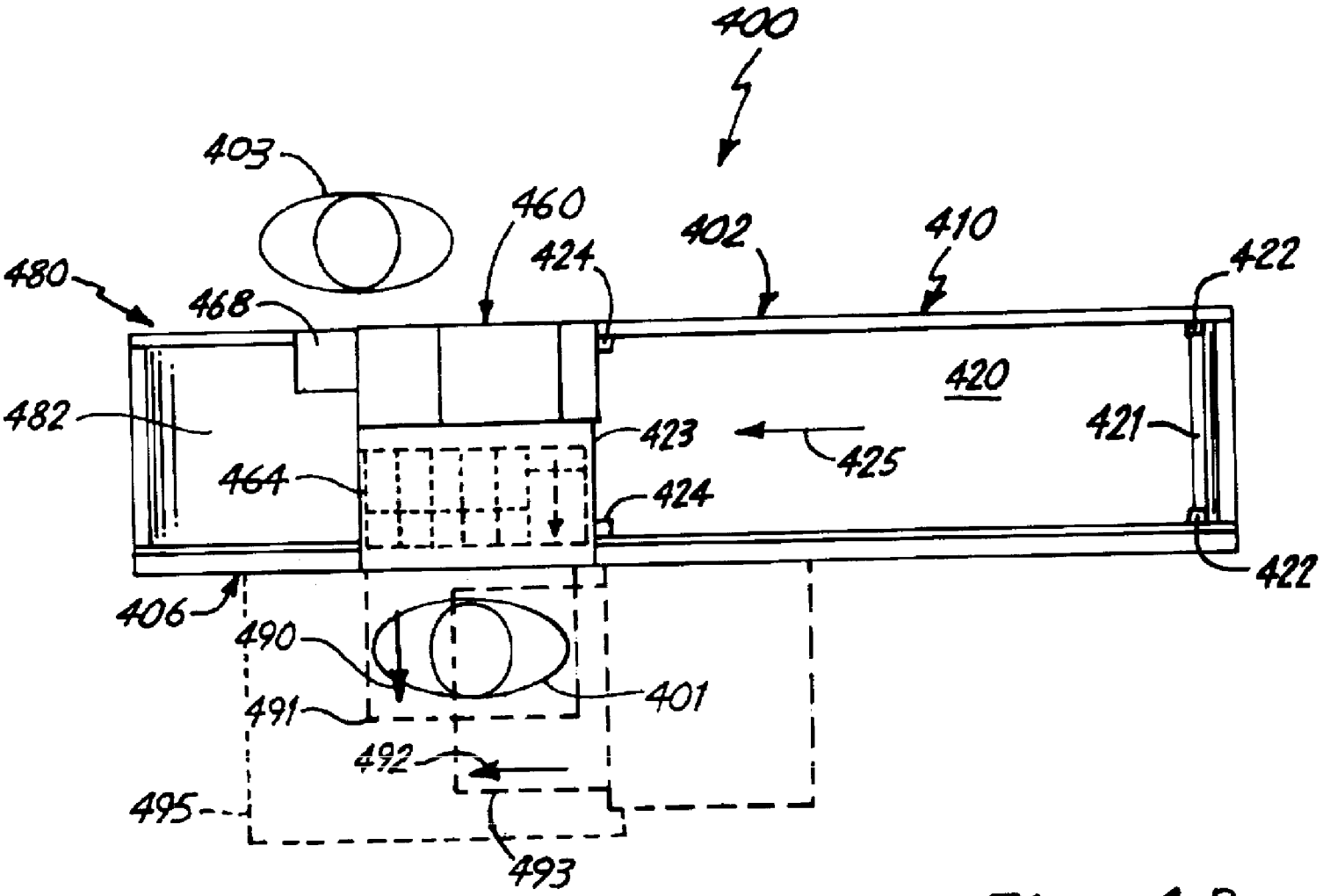
FIG. 4B is a top plan view of the cash stand in FIG. 4A.
Figure 4C:
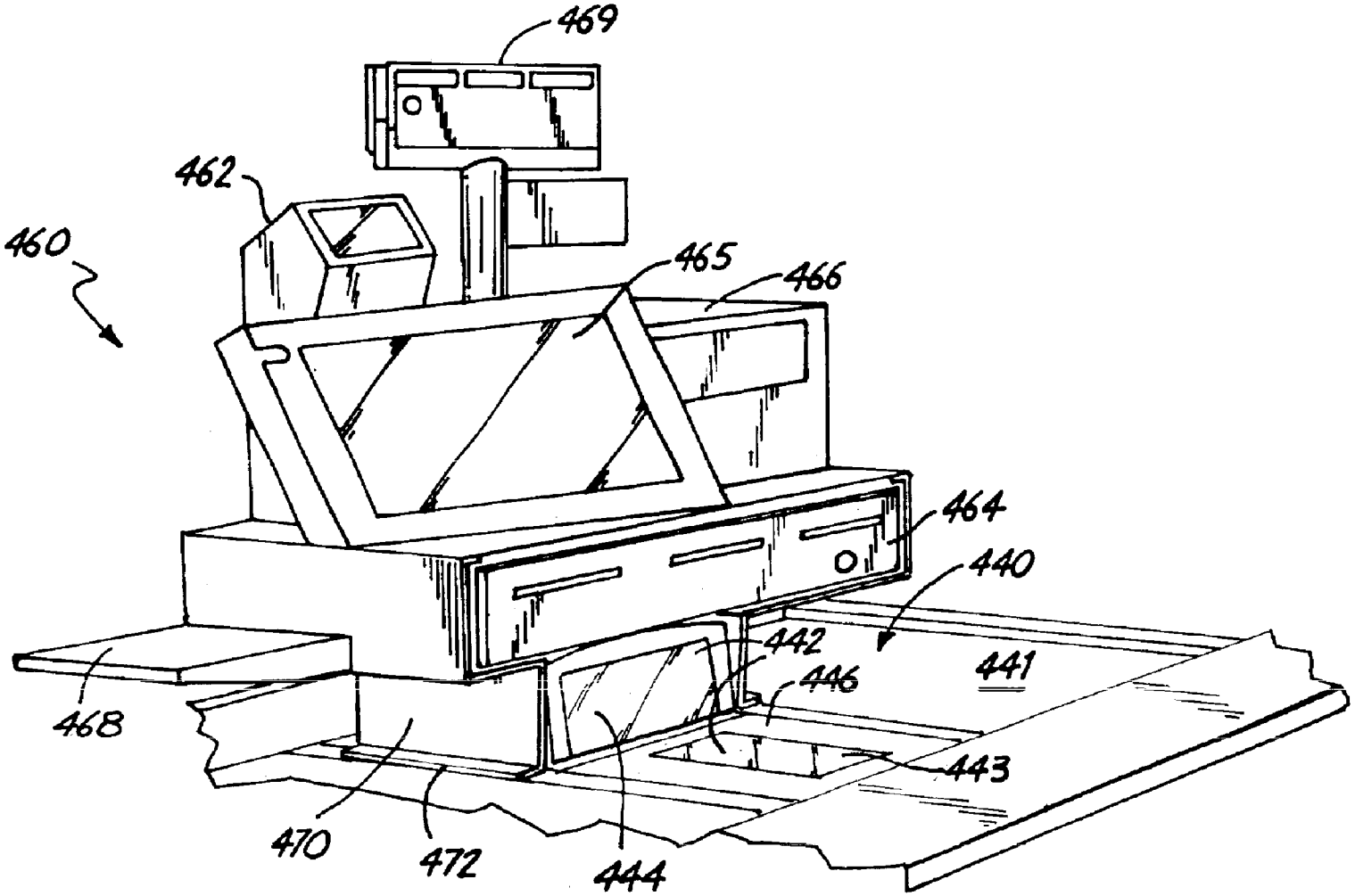
FIG. 4C is an enlarged view of the scanning and transaction areas of the cash stand in FIGS. 4A and 4B.

FIGS. 4A–C are diagrammatic illustrations of a check stand 400 incorporating a cash drawer 14 and a podium 200 according to one embodiment of the present invention. Check stand 400 includes a product unloading area 410, a scanning area 440, a transaction area 460, and a bagging area 480.

The product unloading area 410 includes a belt mechanism 420 configured to move products for purchase towards scanning area 440, such that those items may be scanned by a cashier 401. However, other mechanisms for moving products for purchase towards the scanning area 440 can be used. Furthermore, check stand 400 can be configured without product unloading area 410.

Product unloading area 410 also includes a first item sensor 422 and a second item sensor 424. Item sensors 422 and 424 are in one embodiment photo detector devices which can detect the presence of an item or product at predetermined locations on belt 420. The photo detector device of sensors 422 and 424 is configured to detect a product on belt 420 when a light beam generated by the sensors 422 and 424 is interrupted by the product. However, other devices that are capable of detecting the presence of items or products on belt 420 can be used. Item sensors 422 and 424 are provided to facilitate product movement from a first location on belt 420 to a second location on belt 420. In particular, the customer places a product at an area near the proximate end of the product unloading area 410. The product then flows in a direction towards scanning area 440 as illustrated by arrow 425. Once the product is scanned or otherwise entered at scanning area 440. The item moves from scanning area 440 towards bagging area 480.

First item sensor 422 is provided to determine when a customer placing a product on the proximate end 421 of belt 420. Although only a single sensor 422 is shown it should realized that any number of item sensors 422 can be used to detect product placement at location near the proximate end 421 of belt 420. As described in greater detail below, once this sensor 422 detects the presence of a product of on belt 420, a motor (not illustrated separately) attached to belt 420 is activated to move belt 420, and causes the product on belt 420 to move towards the scanning area 440 in the direction indicated by arrow 425. Specifically, activation of the motor causes the product to move towards scanning area 440 until it reaches a predetermined location. This predetermined location is determined by the placement of second sensor 424. In the embodiments illustrated in FIGS. 4A and 4B, sensor 424 is located at a distal end 423 of belt 420. This location of sensor 424 is just prior to the scanning area 440. Once the product is advanced to the location of sensor 424, belt 420 stops as the product interrupts the light beam generated by sensor 424. Preferably, sensor 424 stops the movement of products on belt 420 such that the products on the belt can be easily scanned or otherwise handled by the cashier 401.

Referring now to FIG. 4C, scanning area 440 of check stand 400 includes a scanner 442, and can also include a product scale 446. Scanner 442 conventionally scans or reads a product identification code such as a universal product code (UPC), industrial symbols, alpha numeric characters, or other indicia associated with product to be purchased. Any commercially available scanner can be used in the present invention.

Scanner 422 includes a first scanning window 443 and a second scanning window 444. First scanning window 443 is positioned substantially parallel to a product path surface 441. The second scanning window 444 is oriented substantially perpendicular to the product path surface 441. As illustrated in FIGS. 4A and 4C first scanning window 443 is positioned in a relatively flush mount arrangement with the product path surface 441. Furthermore, product scale 446 can be integrated with scanner 442. Specifically, product scale 446 is substantially parallel to the product path surface 441 and first scanning window 443. Product scale 446 envelops or surrounds the first scanning window 443. In operation, a product, such as produce, is placed upon the product scale 446 or upon the first scanning window 441 in order to determine the weight of the product, and thus the price to be charged.

Scanner 442 also includes a light source (not illustrated separately) such as a laser, a rotating mirror (not illustrated separately) which is driven by a motor (not illustrated separately), and a mirror array (not illustrated separately). A laser beam reflects off the rotating mirror and the mirror a ray to produce a pattern of scanning light beam. As the product identification code on an item is passed over scanner 442 the scanning light beams scatter off the code and return the scanner 442 where they are collected and detected. The reflected light then is analyzed electronically in order to determine whether the reflective light contains a valid code pattern. When a valid code pattern is present, the product identification code may be utilized to retrieve product information such as the price of the product. Further, scanner 442 and product scale 446 are removably mounted to the check stand 400 and to scanning area 440. This removability allows the replacement and repair of scanner 442 and product scale 446 without the need to disassemble check stand 400.

Scanning area 440 can also include a security deactivation device. The security deactivation device is provided to deactivate or otherwise disable security tags associated with electronic article surveillance systems.

As illustrated in FIGS. 4A and 4B, check stand 400 has a customer facing side 402 and a cashier facing side 406. Specifically, a base portion 408 divides the check stand 400 into the customer facing side 402 which is the side of the check stand 400 where the customer 403 is located during a check out transaction, and the cashier facing side 406 which is the side of check stand 400 where the cashier 401 is located during the check out transaction.

Transaction area 460 of check stand 400 include components necessary to complete a retail purchase, such as receiving payment for purchase products, and printing of transaction receipts. Transaction area 460 is shown in more detail in FIG. 4C. In particular, the transaction area 460 of check stand 400 includes an electronic payment terminal 462 having a card reader and a keypad, a cash drawer 464, a register console 465, a receipt printer 466, a check writing stand 468 and a display device 469. These components are attached to podium 470, which is similar to the podium described in FIGS. 2 and 3 above. Podium 470 is attached to check stand base 408 at connection area 472. Podium 470 can be attached directly at the top portion of check stand 400 or may have a pole that extends down the side of the customer facing side 402 of check stand 400.

Register console 465 can include can include a numeric keypad, an alpha numeric keypad, a listing of items typically purchased by customers at the establishment, a method of payment, or specialized keys for special or common transactions used by the establishment. However, other components and keys can be provided in console 465.

Podium 470 is configured to place cash drawer 464 and register console 465 at a height that is most ergonomically correct for the general populous. This optimal height is generally between the height of the naval and the heart of the cashier. Podium 470 places cash drawer 464 at a height such that this height matches the fifth percentile female and the ninety-fifth percentile male.

The components in transaction area 460 are arranged so as to enhance the efficiency and throughput associated with the operation of check stand 400 by the cashier. In particular, once the cashier has entered the last of the customer's products, the display device 469 displays a final price to the customer. The customer then tenders payment to the cashier, or swipes a credit/debit card through card reader 462. If the customer pays using a credit/debit card a receipt is generated by printer 466. The cashier then takes the receipt, and gives it to the customer to sign on check writing surface 468. If the customer tenders cash for payment the cashier then enters the amount tendered on console 465 that is mounted on podium 470. Once the amount tendered has been entered into the register console 465 by the cashier a signal is sent to cash drawer 464. This signal causes cash drawer 464 to open, thereby exposing the contents of cash drawer 464 to the cashier. It should be noted, that cash drawer 464, when opened, illustratively does not extend beyond the cashier facing side 406, as illustrated in FIG. 4B. Cash drawer 464 opens into the space over scanner 442. At the time cash drawer 464 is open no scanning can be performed by the cashier, as drawer 464 interferes with the scanning path. Once the cashier is finished placing the customer's tendered cash into the cash drawer 464, and making any necessary change; the cashier shuts or closes cash drawer 464 and gives any change to the customer.

After, the products have been scanned by scanner 442 or otherwise passed through scanning area 440, the products are bagged at bagging area 480. Bagging area 480 can take various forms depending on the needs of the retailer. In the embodiment illustrated in FIG. 4A, bagging area 480 consists of a rotatable triangular shaped block having plastic bags attached along its three sides. As the products are moved from scanning area 440 to bagging area 480 the cashier places the products into the bags in bagging area 480. In another embodiment, the products are placed on a second belt 482, illustrated in FIG. 4B which then proceeds to move to the products to a remote bagging station (not illustrated in FIG. 4B) to be bagged by the customer or a bagger. However, other arrangements of bagging area 480 can be used depending on the needs of the retailer.

The arrangement of the present invention presents numerous advantages over prior art cash stands. In particular, during the entire check out operation and process the cashier is able to maintain eye contact with the customer, because all of the components that the cashier needs during the transaction are located directly in front of the cashier. When the transaction is being finalized the cashier is not required to move or change position within the cashier work space 495, as no components intrude into the cashier's work space 495. In prior art cash stands when the cashier finalized the transaction the cash drawer would intrude into the cashier's work space 495, as illustrated in phantom by arrows 490 and 492 and boxes 491 and 493, thus requiring the cashier to move in order to avoid being hit or contacted by the cash drawer as it opened. These and other cash drawer arrangements also required the cashier to break eye contact with the customer to access the contents of the cash drawer. By breaking eye contact with the customer and the contents to complete the transaction there is an increased likelihood of unnoticed theft by the consumer or other person.

Although the present invention has been described with reference to preferred embodiments, those skilled in the art will recognize that changes may be made in form and detail without departing from the spirit and scope of the invention.

What is claimed is:

1. A short depth cash drawer assembly, comprising:

a cash drawer having an opening device interface region, an open top side, a till holding portion, a front portion, a rear portion, and first and second side surfaces, the opening device interface region being disposed to one side of the cash drawer;

an opening device for opening the cash drawer at the opening device interface region having a rear portion being disposed between the front and the rear portions of the cash drawer when the cash drawer is in a closed position;

at least one support configured to support the cash drawer when the cash drawer is opened; and wherein the opening device interface region is disposed between the first and second side surface of cash drawer.

2. The short depth cash drawer assembly of claim 1 further comprising:

a housing having a top surface, a bottom surface, a back section, and two side sections, the back and two side sections each connected to an edge of the top surface and to an edge of the bottom surface.

3. The short depth cash drawer assembly of claim 2 further comprising:

the at least one support coupled to a portion of the housing the at least one support providing a sliding surface for the cash drawer to slide upon when the cash drawer is opened or closed.

4. The cash drawer assembly of claim 3 wherein the cash drawer is releasable coupled to the at least one support.

5. The cash drawer assembly of claim 2 wherein the housing and the cask drawer are comprised of plastic.

6. The cash drawer assembly of claim 2 wherein the opening device interface region is located to a right band side of the till holding portion.

7. The cash drawer assembly of claim 1 wherein the opening device interface region is located to a left band side of the till holding portion.

8. The cash drawer assembly of claim 1 wherein the depth of the cash drawer is less than 14 inches.

9. The cash drawer assembly of claim 1 wherein the depth of the cash drawer assembly is approximately 11 inches.

10. The cash drawer assembly of claim 1 wherein the opening device is a spring being compressed when the cash drawer is in a closed position, and being expanded when the cash drawer is in an open position.

11. The cash drawer assembly of claim 1 further comprising:

a latch configured to restrain the cash drawer in a closed position, the latch further configured to release the cash drawer when the input is received from the cashier.

12. The cash drawer assembly of claim 1 wherein the housing and cash drawer are comprised of steel.

13. The cash drawer assembly of claim 1 further comprising:

a till coupled to the till holding portion of the cash drawer, the till being configured to hold currency.

14. The cash drawer assembly of claim 13 wherein the till is removably coupled to the cash drawer.

15. The cash drawer assembly of claim 13 wherein the cash drawer is configured to store paper currency in a flat configuration.

16. The cash drawer assembly of claim 13 wherein the cash drawer is configured to storm paper currency in an on end configuration.

17. A check stand including the short depth cash drawer assembly of claim 1 comprising:

a cashier facing side;

a customer facing side;

a work surface comprising a scanner integrated into the work station disposed between the cashier facing side and the customer facing side; and a cash drawer receiving portion generally above the work surface and a scanner head and generally in line with, but not over a scanner bed.

18. The check stand of claim 17 wherein the cash drawer receiver portion is configured such that a rear portion of the cash drawer receiver portion does not extend beyond the customer facing side.

19. The check stand of claim 17 wherein the cash drawer receiving portion is displaced away from the cashier facing side a distance such that when the cash drawer is open the front portion of the cash drawer does not extend beyond the cashier facing side.

20. A method of checking out a consumer using a cashier and a check stand, the check stand having a cashier facing side, a consumer facing side and a work surface therebetween, the work surface further having a scanner integrated into the surface, the method comprising the steps of:

providing a cash drawer generally above the work surface of the cash stand and above the scanner head and generally inline with but not over a scanner bed of the scanner;

occupying a scanning position that is inline with the scanner and the cash drawer;

scanning a product with the scanner while remaining in the scanning position;

applying an opening force to a portion of the cash drawer that is parallel with a front portion of the cash drawer and is between the front portion, a rear portion and two side portion of the cash drawer;

opening the cash drawer over the scanner bed; and accessing the contents of the cash drawer while remaining generally in the scanning position.

21. The method of claim 20 wherein the opening step opens the cash drawer such that a front portion of the cash drawer does not extend beyond the cashier facing side.

22. The method of claim 21 wherein the opening step further comprises:

opening the cash drawer less than 14 inches.

23. The method of claim 20 wherein the product is received from a right hand side of the cashier.

24. The method of claim 20 wherein the product is received from a left hand side of the cashier.

25. The method of claim 20 wherein the opening step further comprises the steps of:

releasing a restraining latch from the cash drawer.

26. The method of claim 25 wherein the applying an opening force applies the force via a spring.

27. The method of claim 20 further comprising:

receiving the product from the consumer on a belt.

28. A check stand comprising:

a cashier facing side;

a customer facing side;

a work surface comprising a scanner integrated into the work station disposed between the cashier facing side and the customer facing side;

a cash drawer receiving portion generally above the work surface and scanner head and generally in line with, but not over, a scanner bed, and having a depth of less than 12 inches;

an opening device for opening a cash drawer disposed in the cash drawer receiving portion having a rear portion being disposed between a front and a rear portions of the cash drawer when the cash drawer is in a closed position;

wherein the cash drawer receiving portion is displaced away from the cashier facing side a distance such that when the cash drawer is open the front portion of the cash drawer does not extend between the cashier facing side; and wherein the cash drawer receiver portion is configured such that a rear portion of the cash drawer receiver portion does not extend beyond the customer facing side.

* * * * *

UNITED STATES PATENT AND TRADEMARK OFFICE

CERTIFICATE OF CORRECTION

PATENT NO. : 7,059,513 B2
APPLICATION NO. : 10/342106
DATED : June 13, 2006
INVENTOR(S) : Daugs et al.

It is certified that error appears in the above-identified patent and that said Letters Patent is hereby corrected as shown below:

Col. 11, claim 5, line 48 change “cask” to --cash--.

Col. 11, claim 6, line 50 change “band” to --hand--.

Col. 11, claim 7, line 53 change “band” to --hand--.

Col. 12, claim 16, line 14 change “storm” to --store--.

Signed and Sealed this

Third Day of October, 2006

JON W. DUDAS
*Director of the United States Patent and Trademark Office*